US005450106A

United States Patent [19]

Morioka et al.

[11] Patent Number: 5,450,106

[45] Date of Patent: Sep. 12, 1995

[54] RECORDING APPARATUS PROVIDED WITH A MAGNETIC ENCODER FOR A SCANNING CARRIAGE

[75] Inventors: Hisashi Morioka, Kawagoe; Shigemitsu Tasaki, Kawasaki; Shigeo Takenaka, Kamakura; Makoto Kashimura, Yokohama; Nobuaki Iwakami, Machida; Masafumi Wataya, Kawasaki; Toshiyuki Onishi, Yokohama; Yoshiaki Kaburagi, Kawasaki; Hajime Yoshida, Yokohama; Yuichi Hirai, Kawasaki, all of Japan

[73] Assignee: Canon Kabushiki Kaisha, Tokyo, Japan

[21] Appl. No.: 44,072

[22] Filed: Apr. 8, 1993

[30] Foreign Application Priority Data

Apr. 14, 1992 [JP] Japan ..... 4-120131
Apr. 16, 1992 [JP] Japan ..... 4-122741

[51] Int. Cl.[6] ..... B41J 19/18
[52] U.S. Cl. ..... 347/37; 400/322
[58] Field of Search ..... 346/75, 140 R; 400/322, 400/328, 335; 347/14, 37, 5

[56] References Cited

U.S. PATENT DOCUMENTS 3,751,083 8/1973 Jacobson et al. ..... 287/60

FOREIGN PATENT DOCUMENTS 61-5973 1/1986 Japan ..... 400/322
62-193864 8/1987 Japan ..... 400/322
63-77772 4/1988 Japan ..... 400/322
1514655 10/1989 U.S.S.R. ..... 400/322

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

In a recording apparatus employing a magnetic linear encoder that includes a magnetized scale and a magnetic head movable along the scale, in order to enable efficient mounting of the scale on the recording apparatus and to enable tension adjustment of the scale, support members are provided for detachably supporting the scale, as is a device for providing tension during the mounting of the scale on side plates of the recording apparatus. Also, the magnetized portion of the scale is positioned behind the carriage. Further, the magnetic head is provided with dust shield members which are in contact with, but rendered slidable with respect to, the scale.

8 Claims, 12 Drawing Sheets

RECORDING APPARATUS PROVIDED WITH A MAGNETIC ENCODER FOR A SCANNING CARRIAGE

BACKGROUND OF THE INVENTION

1. Field of the Invention

The present invention relates to a recording apparatus utilizing a magnetic linear encoder.

2. Related Background Art

For detecting the position or the amount of displacement of the carriage in a recording apparatus, there is generally employed a linear encoder, which has generally been known as the optical type and the magnetic type.

The optical linear encoder, based on optical reading of slits formed on a stripe-shaped scale, has been associated with drawbacks of reading errors in the case of dust deposition on the scale, and of the limitation in the precision of detection, because the pitch of the slits cannot be made small (minimum pitch being about 140 μm) due to the restrictions on the process of forming slits on the stripe-shaped scale.

On the other hand, the magnetic linear encoder, relying on magnetic reading of magnetized portions of a magnetic material, has the features of being not influenced by the dust, also being capable of improving the precision of detection as the pitch of magnetization in the magnetized portions can be made smaller (minimum pitch being about 40 μm), and showing faster response speed.

Such a magnetic linear encoder is recently attracting attention, as there have been developed magnetic materials that can be worked by pressing, drawing or scraping, and that are lower in cost.

FIG. 1 schematically shows a recording apparatus employing a conventional magnetic linear encoder. A recording head 1 generally contains an ink jet head and an ink tank in an integral manner, is preferably mounted in a the recording apparatus in detachable manner and is replaced by a new recording head unit when the ink in the ink tank is exhausted.

A carriage 2, supporting the recording head 1, is provided with a pin (not shown) engaging with a spiral groove of a lead screw 3, which is rotated, through a transmission mechanism (not shown), by a carriage motor (not shown) in the forward or reverse direction, whereby the carriage 2 is reciprocated in the directions a and b. An (magnetic resistance) element (not shown in FIG. 1) is provided in a magnetic head 12 for reading the magnetized portions of a scale 11.

A transport roller 4 advances a recording sheet 5 in a direction c, and the recording sheet 5 is intermittently transported during the recording operation. The magnetic head 12 is provided with a flexible printed circuit board 13 for extracting the output signal of the MR device in the magnetic head, and the circuit board is connected to a board 6 loaded on the carriage 2, by connecting a contact portion 14 to a connector (not shown).

In the conventional magnetic linear encoder employed in the recording apparatus, a magnetized scale, mounting members provided at the ends of the scale for mounting the scale to the main body of the recording apparatus, a magnetic head for detecting the magnetized portions, and a signal cable connected to the magnetic head are constructed in an integral manner.

Such a magnetic linear encoder is assembled to the main body of the recording apparatus by forming mounting holes on fixing members (side plates) at both sides of the main body, inserting both the ends of the scale into the mounting holes and applying a fixing pin from the outside of a fixing member.

More specifically, with reference to FIG. 2, the mounting members 21 fixed on both ends of the scale 11 are respectively inserted into holes formed on the fixing members (side plates) 10 of the main body of the recording apparatus, and then a fixing pin 29 is inserted in a gap between the fixing member 10 and the mounting member 21, whereby the scale is fixed to the main body.

Also, as shown in FIG. 3 which is a lateral cross-sectional view of the magnetic linear encoder employed in a recording apparatus, the magnetized portion 15 of the scale 11 is provided in an upper portion thereof and is read by the MR device **12*a* of the magnetic head 12**.

The magnetized portion 15 of the scale 11 is not completely shielded from the outside.

In the above-explained fixing method, however, at the insertion of the ends of the scale into the holes of the fixing members 10, the magnetized portion may be damaged by the eventual contact with an end of the hole formed in the fixing member 10 or with the hand of the operator.

Also, at the fixation of the scale, because the magnetic head 12 and the signal cable (flexible printed circuit board) 13 mounted on the magnetic head are integrally constructed with the scale 11, there is required careful handling so that the fixing operation cannot be conducted efficiently.

Furthermore, since the scale is fixed, by the fixing pin 29, to the main body of the recording apparatus, the tension on the scale 11 cannot be maintained constant nor be regulated at a suitable value, so that the aid tension tends to fluctuate by the errors in the manufacture of the fixing members 10 and the scale 11.

Furthermore, in the conventional magnetic linear encoder, the magnetized portion positioned in the upper part of the scale is easily contacted by the hand of the user, thus being eventually damaged and losing the memory effect of the magnetization.

Also, the magnetized portion 15 of the scale 11 is not so constructed as to be completely shielded from the exterior, as mentioned above, so that fine particles such as paper dust may enter the gap between the magnetized portion 15 of the scale 11 and the magnetic head 12 thereby hindering proper detection or eventually destroying the magnetic head itself. Such fine particles are not limited to paper dust but also maybe dust generated from the surroundings, depending on the place of installation of the apparatus.

Also, in order to read the magnetized pattern of the magnetized portion 12 with the MR device 14, the air gap G therebetween, shown in FIG. 4, has to be maintained in the order of 10 μm. The magnetic linear encoder has been inevitably expensive, as there are required a complex mechanism for ensuring the air gap G and adjustment therefor.

For avoiding these drawbacks, the magnetic material is formed as a wire, which is incorporated in a housing with the magnetic head formed in a bearing, thereby maintaining a constant air gap.

At the fixation of the wire-shaped scale in the recording apparatus, since appropriate positioning is difficult with a wire of having a circular cross section, the scale is given, at both ends, fixing members by which the positioning to the recording apparatus is achieved.

In such a conventional configuration, however, the additional fixing members for the scale increase the number of components and complicate the manufacturing process as they require a step of positioning and fixing the fixing members on both ends of the scale, thus constituting a factor of increased cost of the magnetic linear encoder.

Furthermore, the angle between the MR device of the magnetic linear encoder and the magnetized portion of the scale tends to increase by the addition of the above-mentioned fixing members and the addition of the fixing step.

SUMMARY OF THE INVENTION

A principal object of the present invention is to provide a recording apparatus utilizing a magnetic linear encoder not associated with the above-mentioned drawbacks.

Another object of the present invention is to provide a recording apparatus allowing efficient mounting of the scale of the magnetic linear encoder to the main body of the recording apparatus.

Still another object of the present invention is to provide a recording apparatus enabling tension adjustment, at the mounting of the scale of the magnetic linear encoder to the main body of the recording apparatus.

Still another object of the present invention is to provide a recording apparatus in which the magnetized portion of the scale of the magnetic linear encoder is not easily touched by the hand of the user.

Still another object of the present invention is to provide a recording apparatus which is so constructed that fine dust cannot enter the gap between the magnetized portion of the scale and the magnetic head.

Still another object of the present invention is to provide a recording apparatus utilizing a magnetic linear encoder which can be positioned with a high precision to the recording apparatus and which can be easily mounted thereon.

Still another object of the present invention is to provide a recording apparatus utilizing a magnetic linear encoder which eliminates the angular difference between the MR device and the magnetized portion and which does not require an adjusting process or components of a high precision.

DESCRIPTION OF THE PREFERRED EMBODIMENTS

Now the present invention will be clarified in detail by an embodiment thereof shown in the attached drawings.

Figure 1:
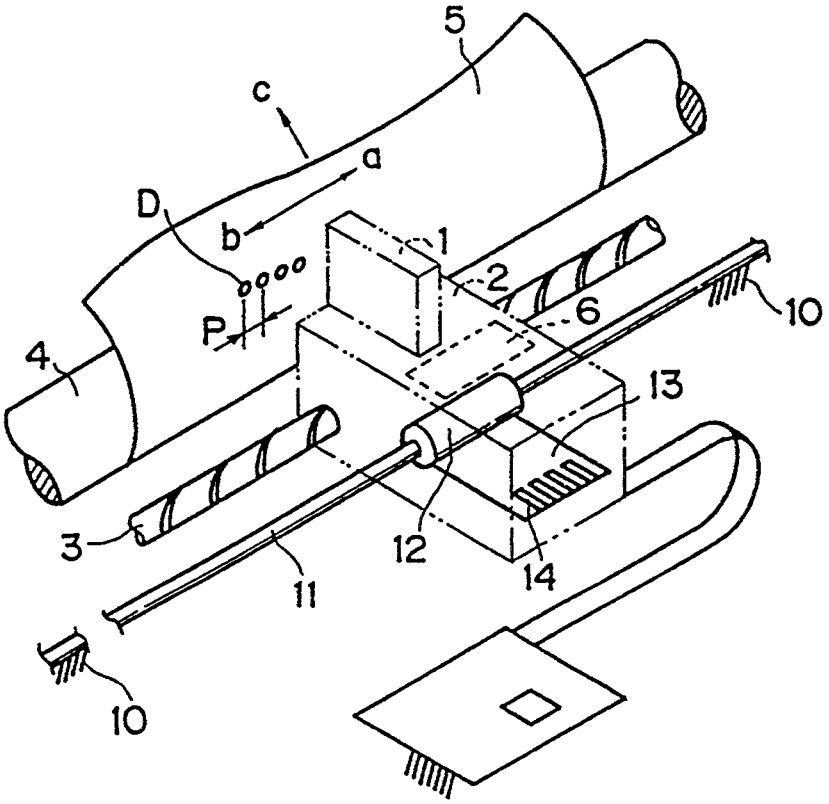
FIG. 1 PRIOR ART
FIG. 1 is a perspective view of a recording apparatus employing a conventional magnetic linear encoder.
Figure 2:
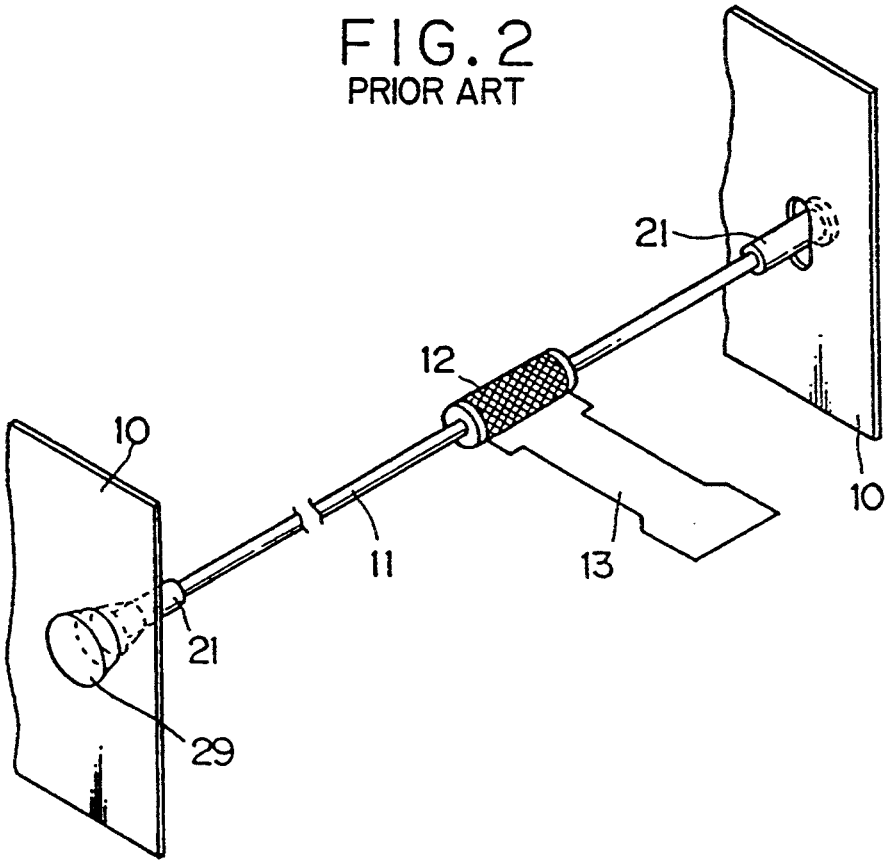
FIG. 2 PRIOR ART
FIG. 2 is a schematic view showing the mounting method of the magnetic linear encoder, shown in FIG. 1, to the main body of the recording apparatus.
Figure 3:
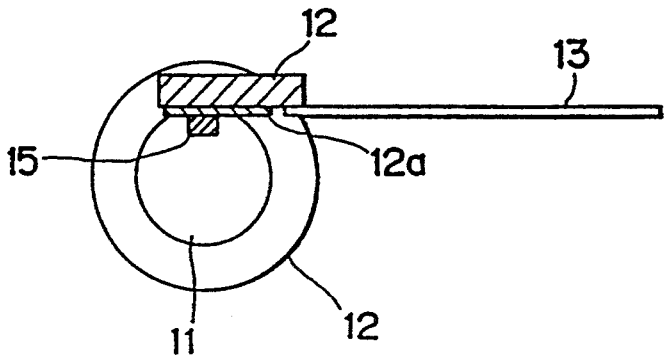
FIG. 3 PRIOR ART
FIG. 3 is a cross-sectional view of the magnetic linear encoder shown in FIG. 1.
Figure 4:
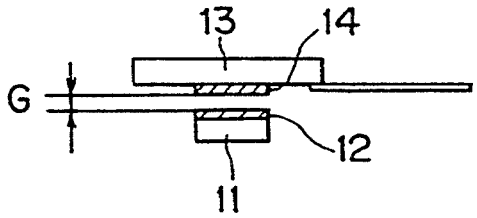
FIG. 4 PRIOR ART
FIG. 4 is a cross-sectional view showing an air gap between the reading portion of the magnetic head and the magnetized portion of the scale in the magnetic linear encoder shown in FIG. 3.
Figure 5:
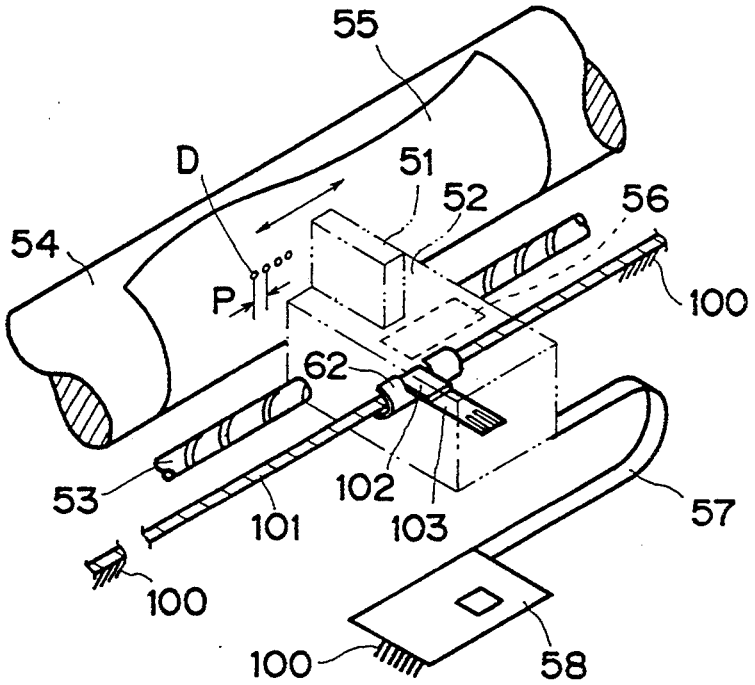
FIG. 5 is a perspective view of a recording apparatus employing a magnetic linear encoder, constituting a first embodiment of the present invention.

FIG. 5 illustrates a recording apparatus employing a magnetic linear encoder, wherein a carriage 52, represented by chain lines, supports a recording head 51 of wire dot type, thermal transfer type or ink jet type. The carriage 52 is guided by a lead screw 53 having a spiral groove on the periphery thereof, and the engaging part of the carriage 52 is driven along said spiral groove by the rotation of the lead screw 54, whereby the carriage reciprocates as indicated by an arrow, with respect to a recording medium 55 which is wound on and advanced by a platen 54 and records an image or characters by forming dots D with a pitch P on the recording medium 55.

The carriage 52 thus constructed is provided with a magnetic linear encoder, for the purpose of detecting the position or the amount of displacement of the carriage. The magnetic linear encoder is composed of a scale 101, consisting of a wire-shaped magnetic material magnetized with a pattern of a pitch of 180 dpi (dot-/inch) or 360 dpi, and fixed on a frame 100 (only schematically illustrated) of the main body of the recording apparatus, and a magnetic head 102 consisting, for example, of an MR device and fixed in the carriage.

A flexible circuit board 103, for extracting the output-signal of the MR device of the magnetic head, is connected to the magnetic head 102, and is also connected to a circuit board 56 (represented by broken lines) on the carriage 52, through a connector (not shown).

The circuit board 56 and the recording head 51 are connected electrically, through a flexible cable 57, to a control circuit board 58 fixed on the frame 100 of the main body.

In the following there will be explained the material, form and magnetizing direction of the scale 101 of the above-mentioned magnetic linear encoder. The scale is preferably composed of an Fe—Cr—Co magnet. The magnet has magnetic characteristics equivalent to those of an Al—Ni—Co magnet, and still overcomes the drawbacks of rigidity and brittleness of the permanent magnets, whereby a wire or a plate on the order of 0.1 mm can be easily manufactured by pressing or drawing. The magnetic material can be formed as a thin film by a film forming method such as sputtering, evaporation or CVD, or as an alloy by sintering or an ordinary alloy forming method. The scale is formed as a wire or a plate with a circular, rectangular or square cross section, and such form can be easily and inexpensively obtained with the aforementioned magnetic material. It is preferably magnetized in the vertical direction, in order to obtain a fine pitch (such a fine pitch being required for example in color printing, which requires the dot control of higher precision than in the monochromatic printing). The material, form and magnetizing direction of the scale adapted for use in the magnetic linear encoder of the present invention are as explained above, but the present invention is not limited by such material, form and magnetizing direction of the scale unless specified in the appended claims. Also, the magnetic detection device adapted for use in the present invention is preferably composed of an iron-nickel alloy magnetic resistance (MR) device, but the present invention is not limited to such an MR device.

Figure 6:
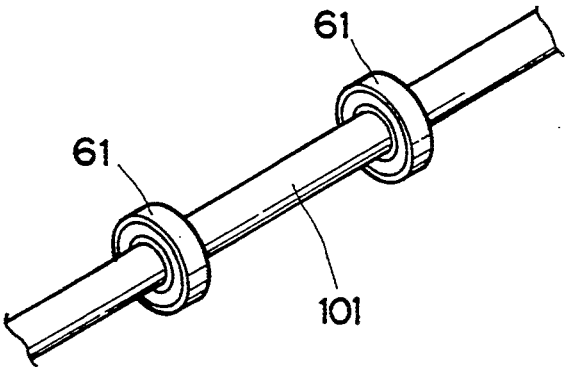
FIG. 6 is a view showing the scale of the magnetic linear encoder shown in FIG. 5.
Figure 7:
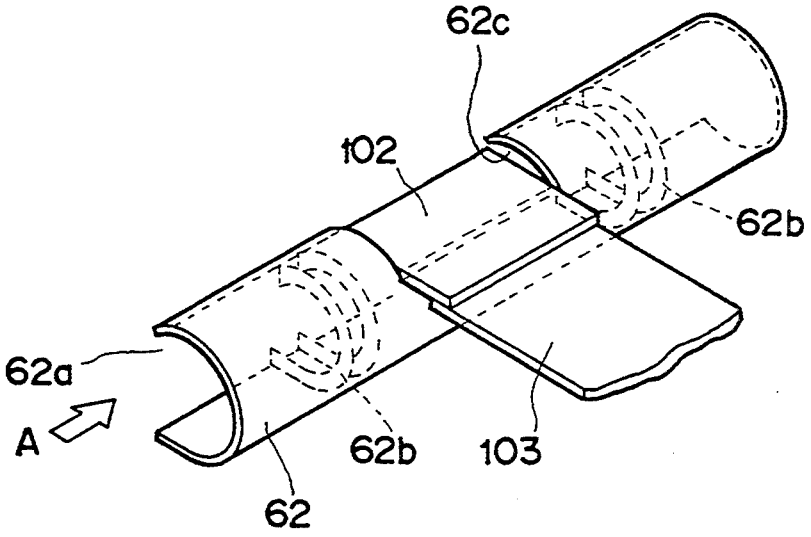
FIG. 7 is a detailed view of a housing and a magnetic head of the magnetic linear encoder shown in FIG. 5.
Figure 8:
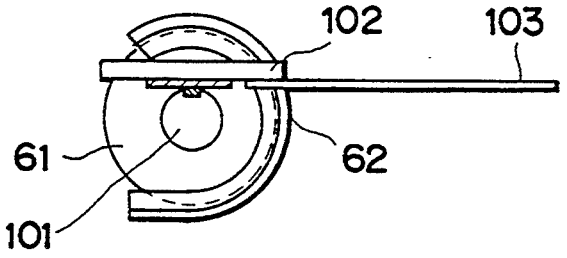
FIG. 8 is a cross-sectional view of the magnetic linear encoder shown in FIG. 5.

As shown in FIG. 6, the scale 101 is provided with two movable bearings 61, which support the magnetic head 102 by means of a housing 62. As shown in FIG. 7, the housing 62 is so molded as to have an arc-shaped cross section a little over semi circle, whereby the scale 101 can be fitted therein from an aperture 62*a* of the cross section. Inside the housing 62 there are provided supporting parts 62*b* in which the bearings 61 are fitted and supported. Also, at the center of the housing 62 there is provided a notch 62*c* in which the magnetic head 102 having a signal line (flexible cable) 103 is provided. Thus, the bearings 61 of the scale 101 are elastically fitted into the supporting parts 62*b* of the housing 62 from the aperture 62*a* thereof. Consequently the housing 62 supports the scale 101 in the fitted state as shown in FIG. 8, and the magnetic head 102 is rendered slidable along the scale 101, by means of the housing 62 and the bearings 61.

Figure 9:
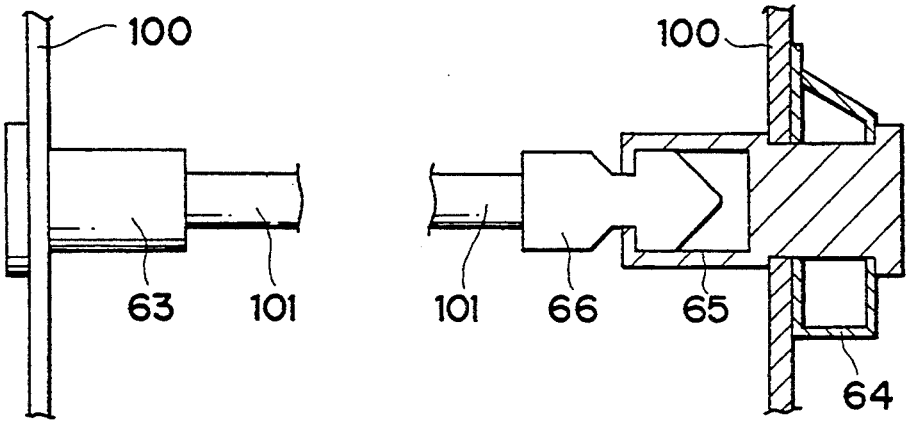
FIG. 9 is a schematic view showing the mounting method of the scale of the magnetic linear encoder, shown in FIG. 5, to the main body of the recording apparatus.

FIG. 9 is a partial cross-sectional view showing the mounting state of the scale 101 of the magnetic linear encoder on the main body of the recording apparatus. A mounting member 63, fixed on an end of the scale 101, is inserted in and fixed to a hole formed in a fixing member (side plate) 100. At the other end of the scale 101, a tension regulating member 65 is fitted, across a plate spring 64 for maintaining the tension of the scale 101, in a hole of a fixing member (side plate) 100, and a mounting member 66 fixed on the other end of the scale 101 is fitted into the tension regulation member 65, whereby the scale 101 is fixed to the side plates 100.

This fixing method can prevent damage to or abrasion of the magnetized portion of the scale 101 by the contact of the hand of the operator at the mounting thereof, and can achieve secure supporting of the scale 101.

Figure 10:
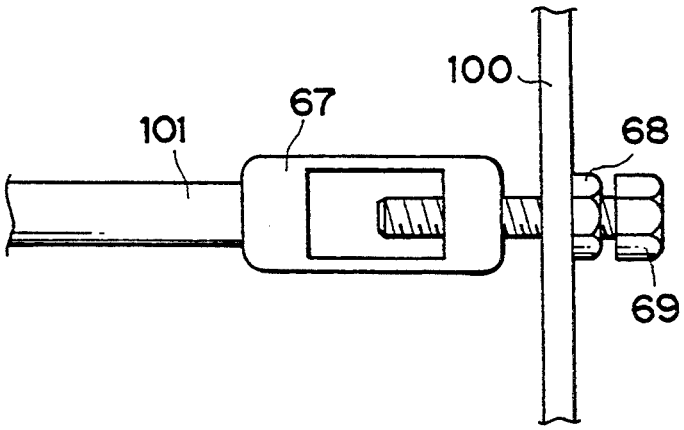
FIG. 10 is a view showing another mounting method of the scale of the magnetic linear encoder, shown in FIG. 9, to the main body of the recording apparatus.

FIG. 10 shows a configuration in which the tension of the scale 101 is regulated by a turnbuckle, wherein the scale 101 is mounted on a side plate of the main body of the recording apparatus by means of a turn-buckle. 67. More specifically, an end of the scale 101 is inserted into a hole formed in the side plate 100 as in FIG. 9, while the other end of the scale 101 is fixed by means of a fixing bolt 69 and a fixing nut 68, which serve to regulate the tension of the scale.

Figure 11:
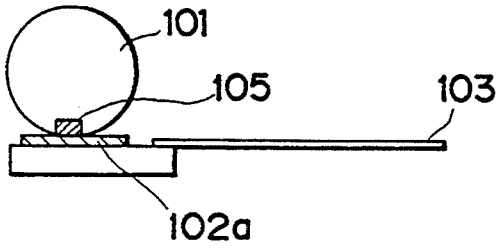
FIG. 11 is a view in which the magnetized portion of the scale of the magnetic linear encoder, shown in FIG. 8, is positioned downwards.

FIG. 11 shows another magnetized state of the scale of the magnetic linear encoder, wherein, in order to protect the magnetized portion 105, it is positioned under the scale 101 namely behind the carriage 2, and the magnetic head 102*a* is so positioned as to read the magnetized portion 105 from thereunder. Such positioning of the magnetized portion 105 behind the carriage 52 allows prevention of the loss of memory effect, resulting conventionally from the eventual contact by the user or from dust invasion from the outside.

Figure 12:
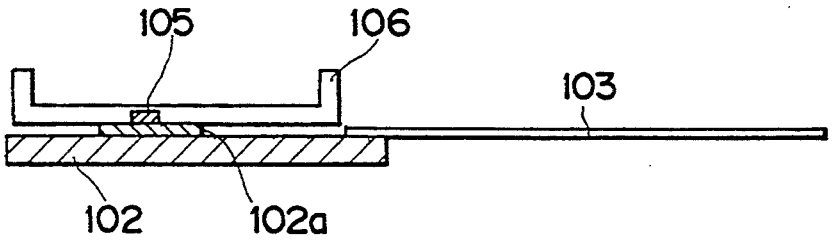
FIG. 12 is a cross-sectional view showing another configuration of the magnetic linear encoder shown in FIG. 8.

In contrast to the rod-shaped scale 101 in the foregoing embodiment, FIG. 12 shows a square-shaped scale 106 with the magnetized portion 105 positioned thereunder, whereby there can be prevented the loss of the memory effect caused by damage to the magnetized portion 105, resulting from the eventual contact by the user or from the dust invasion from the outside.

Figure 13:
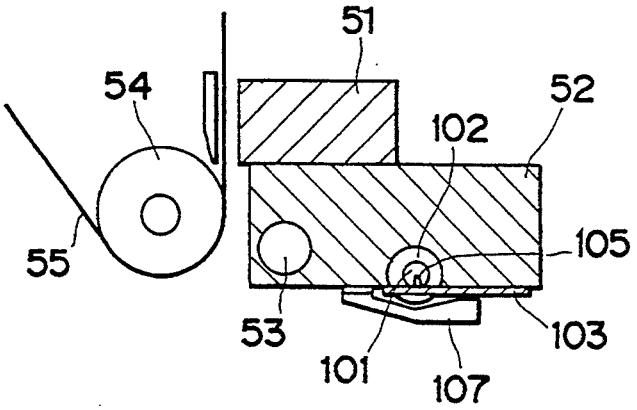
FIG. 13 is a cross-sectional view showing still another configuration of the magnetic linear encoder shown in FIG. 8.

In a configuration shown in FIG. 13, the magnetized portion 105 is positioned on the lower face of the rod-shaped scale 101, namely behind the carriage, as in FIG. 11, Put a scale guide 107 is so provided as to cover the magnetized portion 105 over the entire length thereof, thereby providing more complete protection against the loss of the memory effect. The scale guide 107 may be formed separately from or integrally with the carriage 52.

Figure 14:
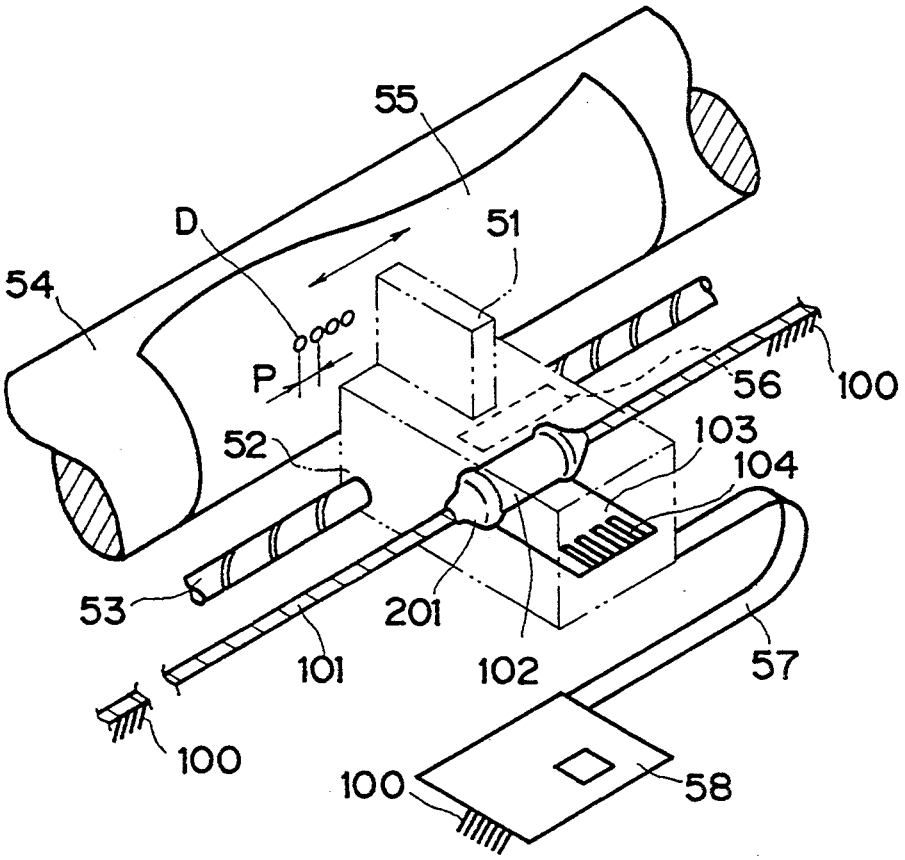
FIG. 14 is a perspective view of a recording apparatus employing a magnetic linear encoder, constituting a second embodiment of the present invention.

In the following there will be explained a second embodiment of the present invention. FIG. 14 shows a recording apparatus employing a magnetic linear encoder, wherein the same components as those in FIG. 5 are represented by the same numbers and will not be explained further.

In the linear encoder employed in this recording apparatus, the scale 101, the cylindrical magnetic head 102 for detecting the magnetized portion and the signal cable 103 mounted on the magnetic head 102 are constructed as integral manner. A dust shield member 201, provided on the magnetic head 102, is a cap of an elastic material such as rubber, and is maintained in contact with the surface of the scale 101 in order to remove fine dust, but is rendered slidable on the scale so as not to generate an excessively large mechanical load.

Figure 15:
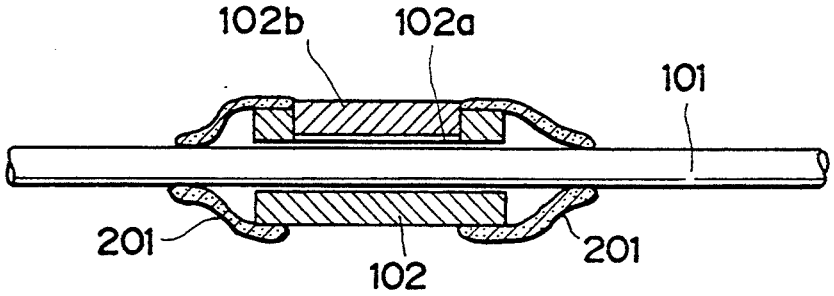
FIG. 15 is a cross-sectional view of the magnetic linear encoder shown in FIG. 14.

FIG. 15 is a cross-sectional view showing the details of the dust shield member 201, which has a small aperture at the center and is formed by an elastic material such as rubber. The magnetic head 102 is provided with a substrate 102*b* for forming the MR device 102*a*, and the substrate is usually composed of glass, metal such as aluminum or a molded article. As will be apparent from FIG. 15, two dust shield members 201 are hermetically mounted on both ends of the magnetic head 102, and central apertures of the members are maintained in close contact with the scale.

Figure 16:
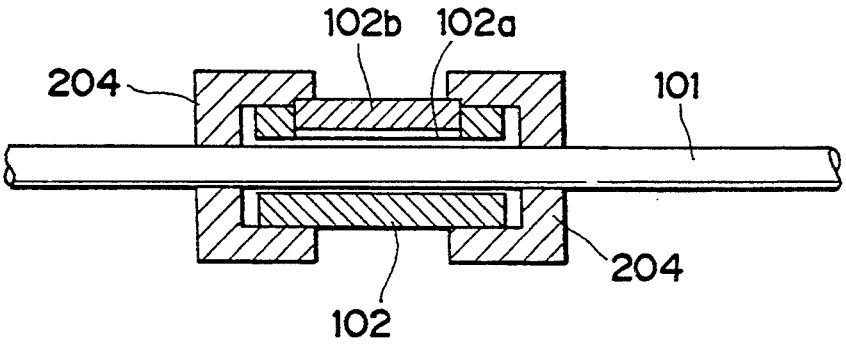
FIG. 16 is a cross-sectional view showing another configuration of the magnetic linear encoder shown in FIG. 15.

FIG. 16 is a cross-sectional view showing another example of the dust shield members, which are formed, in this example, by felt caps 204. As in the foregoing example, the felt caps are mounted closely on the magnetic head 102 and are maintained in contact with and rendered slidable on the scale 101.

Figure 17:
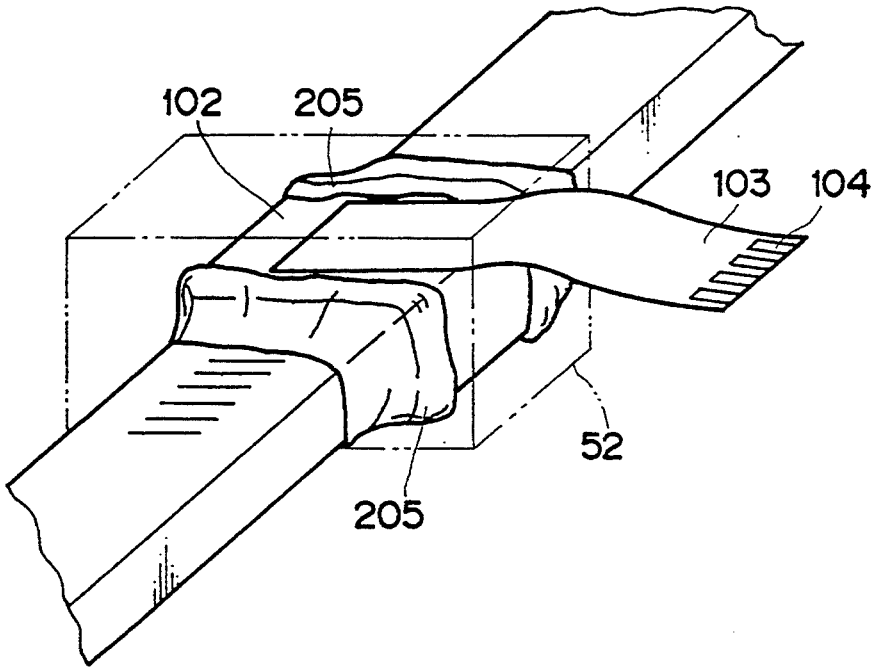
FIG. 17 is a detailed view showing still another configuration of the magnetic linear encoder shown in FIG. 15.
Figure 18:
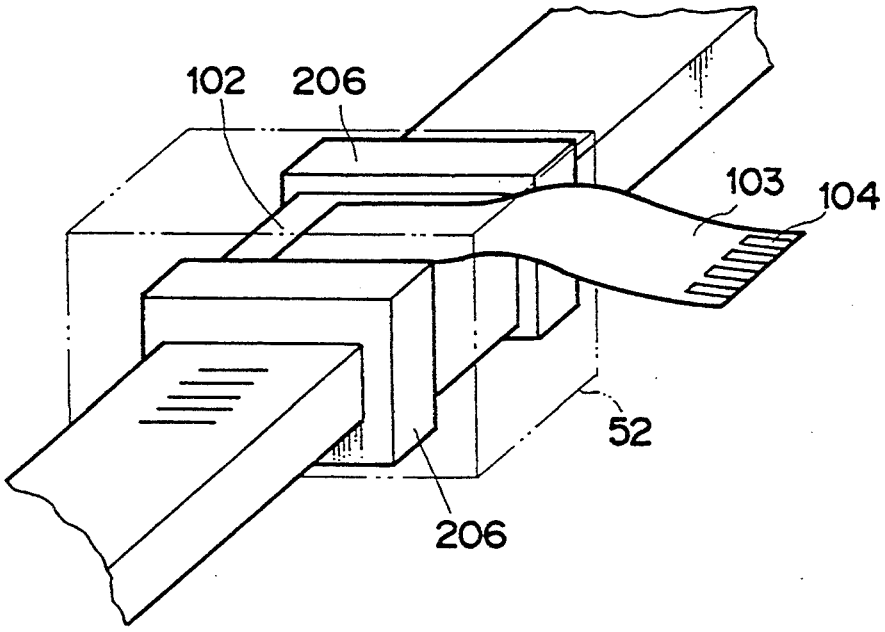
FIG. 18 is a detailed view showing still another configuration of the magnetic linear encoder shown in FIG. 15.

FIGS. 17 and 18 are perspective views showing still other examples of the dust shield members, used on a scale shaped as a flat plate. The dust shield members 205 in FIG. 17 are formed of an elastic material such as rubber, while those 206 in FIG. 18 are formed by felt.

Figure 19:
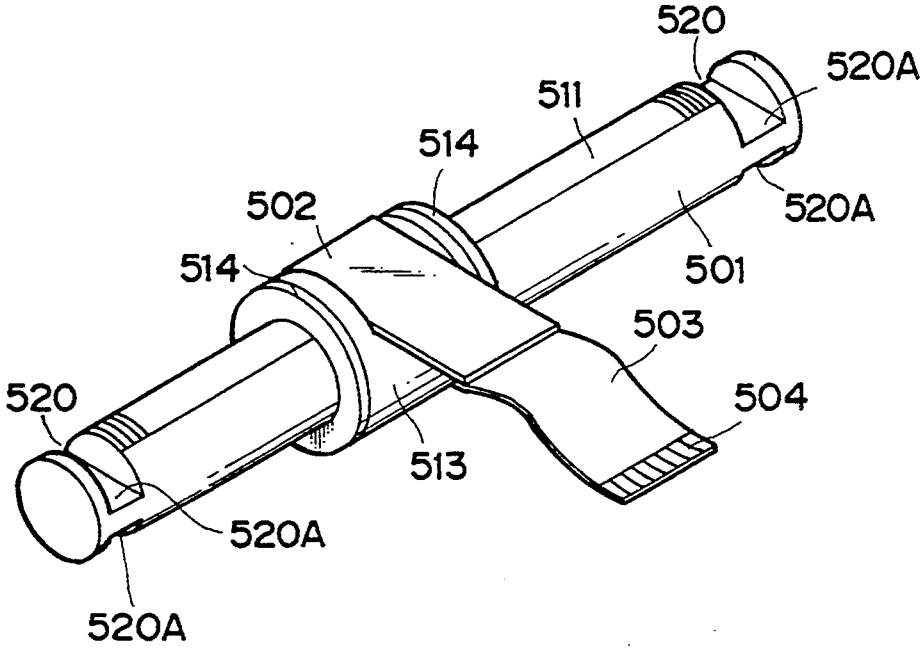
FIG. 19 is a perspective view of a magnetic linear encoder constituting a third embodiment of the present invention.
Figure 20:
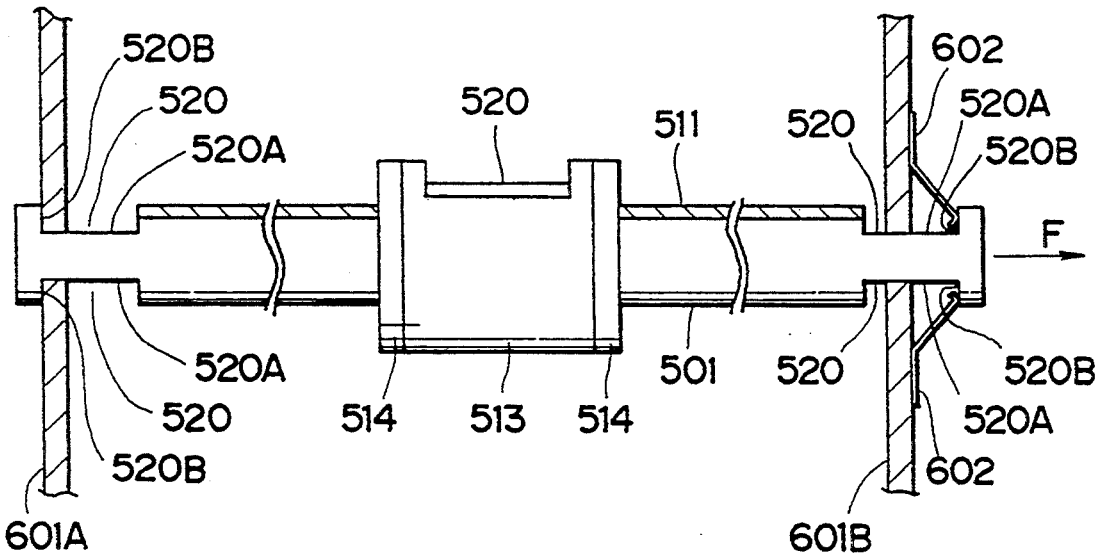
FIG. 20 is a schematic view showing the mounting method of the scale of the magnetic linear encoder, shown in FIG. 19, to the main body of the recording apparatus.

In the following there will be explained a third embodiment of the present invention. FIG. 19 illustrates a magnetic linear encoder, and FIG. 20 shows the magnetic linear encoder in a state mounted on a recording apparatus.

A scale 501 is provided, on both ends thereof, with grooves 520 formed by forging, and a magnetized portion 511 thereof bears a magnetized pattern of a small pitch, formed with reference to a reference plane 520A of the grooves 520 at the end of the scale. The scale 501 is positioned with respect to the main body of the recording apparatus, by fitting the reference faces 520A of the grooves 520 in positioning holes formed on side plates 601A, 601B of the main body. The scale 501 is also positioned longitudinally by impinging an internal face 520B of a groove 520 on the external face of a side plate 601A and biasing the internal face 520B of the groove 520 on the other end in a direction F, shown in FIG. 20, by means of a plate spring 602 mounted on the side plate 601B. The biasing force in the direction F also functions to remove the bending of the scale 501 by the weight thereof.

The main body 502 of the magnetic head is fixed on a housing 513 provided on both ends with bearings 514, 514, which is fitted on the scale 501 to maintain a constant air gap G (10 μm) between the MR device and the magnetized portion 511.

Figure 21:
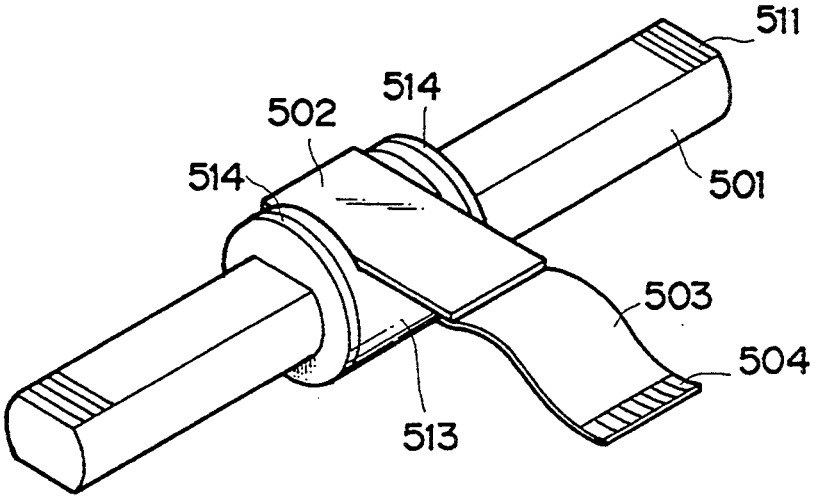
FIG. 21 is a perspective view showing another configuration of the magnetic linear encoder shown in FIG. 19.
Figure 22:
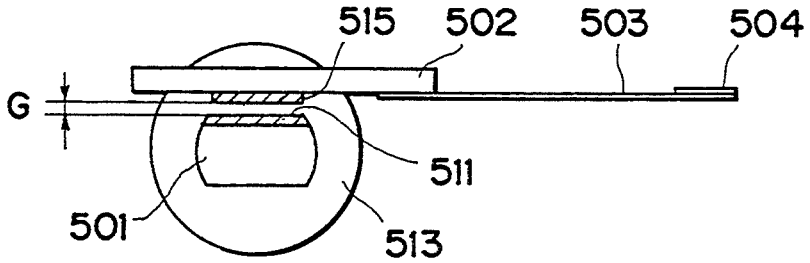
FIG. 22 is a cross-sectional view of the magnetic linear encoder shown in FIG. 19.

FIG. 21 shows another configuration of the magnetic linear encoder shown in FIG. 19, and FIG. 22 shows the linear encoder in a state mounted in a recording apparatus.

The scale 501 has a non-circular cross section in order that bearings 514, 514 of a complementary shape, supporting the magnetic head 502 composed of an MR device, do not rotate on the scale 501. The scale and the bearings can have any arbitrary non-circular cross section in the mutually engaging part, but the cross section preferably has a finite number of symmetrical axes in consideration of the manufacturing process of the linear encoder. As an example, as shown in FIG. 21, the scale 501 has mutually opposed flat faces and is composed of arcs in the remaining portions, and a magnetized portion 511 formed on one of the flat faces bears a magnetized pattern of a small pitch.

The magnetic head 502 is fixed on a housing 513 provided on both ends with bearings 514, 514 which are fitted on the scale 501 to maintain a constant air gap G (about 10 μm) between MR device 515 and the magnetized portion 511. The bearings 514, 514 have flat faces complementary to those of the scale 501, whereby the magnetic head 502 is prevented from rotating with respect to the magnetized portion 511 of the scale 501, and the mutual angle between the MR device 515 and the magnetized portion 511 is maintained within ±5°.

Such cross-sectional shape of the scale 501 having a finite number of symmetrical axes and having flat faces in mutually opposed positions prevents the rotation of the MR device 515 with respect to the magnetized portion of the scale 501 and can ensure a mutual angular difference within ±5° without adjustment, by a simple structure. Also, the magnetization on the flat face of the scale allows enlarging the width of the magnetized area, thereby stabilizing the output of the MR device 515. Furthermore, the cross-sectional shape of the scale with the flat faces allows an operator to visually identify the magnetized portion, thereby enabling simple mounting on the recording apparatus. Also, the flat faces can be utilized in the positioning of the scale at the mounting, thereby simplifying the assembling operation and reducing the cost of the recording apparatus.

Furthermore, the scale can be manufactured by a drawing process, and such a cross-sectional shape as explained above can significantly contribute to the stabilization of the manufacturing operation.

In the foregoing embodiment, the magnetized portion is provided on one side of the cross section of the scale, but, if both of the mutually opposed flat faces are magnetized, the assembling operation can be further simplified, since the mutual positioning of the MR device and the magnetized portion is no longer necessary.

A similar effect can be attained by forming the magnetized portion in an area other than the flat faces in the cross section of the scale.

Furthermore, a similar effect can be attained by forming the internal periphery of the bearings circularly and providing the housing with a portion for preventing the rotation, corresponding to the flat faces in the cross section of the scale. Such a configuration further reduces the cost as the shape of the bearings is simpler.

Figure 23:
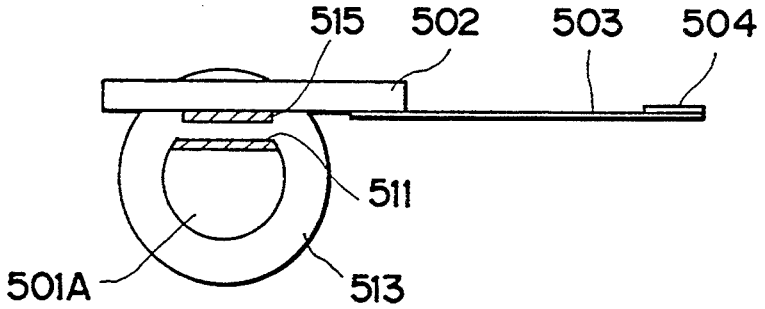
FIG. 23 is a cross-sectional view showing another configuration of the magnetic linear encoder shown in FIG. 22.

Furthermore, a similar effect can be attained by forming the cross section of the scale semicircularly as shown in FIG. 23, and mutually opposed flat faces are not required in this case.

Figure 24:
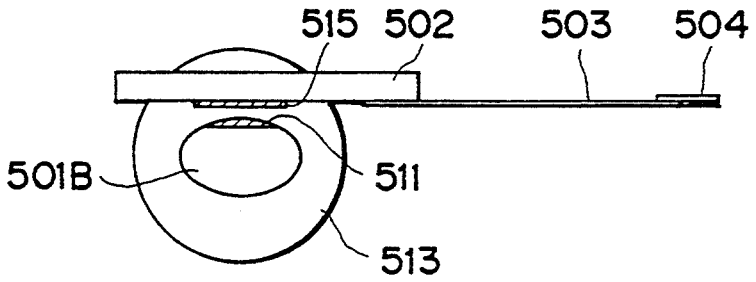
FIG. 24 is a cross-sectional view showing still another configuration of the magnetic linear encoder shown in FIG. 22.

Also, an oval cross-sectional shape of the scale, as shown in FIG. 24, provides a similar effect in preventing the rotation of the MR device with respect to the magnetized portion, and such a configuration contributes to the increase in durability of the magnetic linear encoder.

Figure 25:
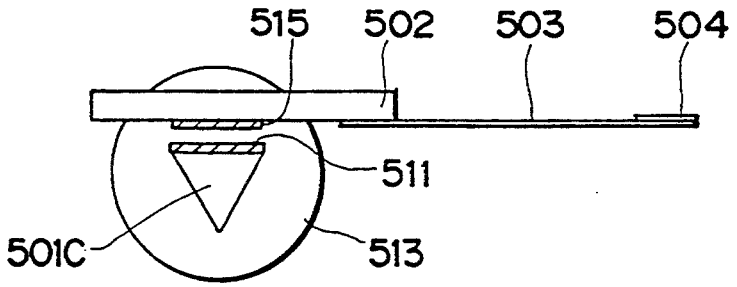
FIG. 25 is a cross-sectional view showing still another configuration of the magnetic linear encoder shown in FIG. 22.

Furthermore, a triangular or polygonal cross-sectional shape of the scale, as shown in FIG. 25, provides a similar effect.

The present invention, in which the grooves are formed integrally with the scale at both ends thereof by forging, provides an inexpensive and highly precise recording apparatus of a simple structure, a high print quality and a high reliability.

In addition, the present invention allows maintaining a constant air gap between the MR device and the magnetized portion of the magnetic linear encoder, and to eliminate the mutual angular difference between the MR device and the magnetized portion, thereby ensuring a stabilized output from the MR device in the recording apparatus. As a result there can be provided an inexpensive and highly reliable recording apparatus of a high print quality.

Furthermore, the present invention allows mounting the scale and the magnetic head to fixing members in a simple manner, without damage to the magnetized portion of the scale, and to maintain said the scale under a regulatable constant tension.

Furthermore, the present invention prevents damage to the magnetized portion of the scale, thereby avoiding loss of the memory effect.

Furthermore, the present invention allows to prevents intrusion of fine dust into the gap between the magnetized portion of the scale and the magnetic head.

What is claimed is:

1. A recording apparatus provided with a magnetic linear encoder for detecting the position of a recording head effecting a scanning motion for recording, said apparatus comprising:

a main body having side plates;

a carriage for mounting the recording head and being movable between said side plates for performing a recording scan;

a scale provided along a direction of movement of said carriage, said scale having a magnetized line magnetized along the direction of movement of said carriage;

a magnetic head for reading the magnetized line on said scale as said carriage moves, said magnetic head and said scale constituting said magnetic linear encoder;

a bearing movably provided on said scale;

a housing for housing said magnetic head and for mounting said bearing; and fixing means for fixing said scale on said side plates of said main body, said fixing means comprising tension applying means for applying tension to said scale.

2. A recording apparatus according to claim 1, wherein said fixing means comprises a mounting member for mounting said scale on said side plates of said main body, and said tension applying means comprises a spring positioned between one of said side plates and said mounting member so as to apply the tension to said scale.

3. A recording apparatus according to claim 1, wherein said fixing means comprises a mounting member for mounting said scale to said side plates of said main body, and said tension applying means comprises a turnbuckle positioned between one of said side plates and said mounting member so as to apply the tension to said scale.

4. A recording apparatus according to claim 1, wherein the magnetized line of said scale is provided in a lower portion thereof.

5. A recording apparatus according to claim 1, further comprising dust shielding protecting means which covers the magnetized portion of said scale.

6. An apparatus according to claim 1, wherein said housing has a semi-circular cross-sectional shape for accepting said bearing.

7. An apparatus according to claim 1, wherein said scale has a semi-circular cross-sectional shape for preventing rotation of said bearing.

8. A recording apparatus provided with a magnetic linear encoder for detecting the position of a recording head effecting a scanning motion for recording, said apparatus comprising:

a main body having side plates;

a carriage for mounting the recording head and being movable between said side plates for performing a recording scan;

a scale provided along a direction of movement of said carriage, said scale having a magnetized line magnetized along the direction of movement of said carriage and having an integrally formed groove to which said side plates are connected;

a magnetic head for reading the magnetized line on said scale as said carriage moves, said magnetic head and said scale constituting said magnetic linear encoder;

a bearing movably provided on said scale;

a housing for housing said magnetic head and for mounting said bearing; and fixing means for fixing said scale on said side plates of said main body, said fixing means fixing said scale by inserting said groove of said scale to holes provided in said side plates of said main body.

* * * * *

UNITED STATES PATENT AND TRADEMARK OFFICE

CERTIFICATE OF CORRECTION

PATENT NO. : 5,450,106

DATED : September 12, 1995

INVENTOR(S) : HISASHI MORIOKA, ET AL.

It is certified that error appears in the above-indentified patent and that said Letters Patent is hereby corrected as shown below:

COLUMN 1:

Line 40, "in a" should read --in-- and "in" should read --in a--.
Line 49, "An" should read --An MR--.

COLUMN 2:

Line 36, "aid" should be deleted.
Line 51, "maybe" should read --may be--.
Line 58, "in" should read --on--.

COLUMN 6:

Line 66, "as" should read --in an--.

COLUMN 8:

Line 13, "Such" should read --Such a--.

UNITED STATES PATENT AND TRADEMARK OFFICE

CERTIFICATE OF CORRECTION

PATENT NO. : 5,450,106

DATED : September 12, 1995

INVENTOR(S) : HISASHI MORIOKA, ET AL.

It is certified that error appears in the above-indentified patent and that said Letters Patent is hereby corrected as shown below:

COLUMN 9:

Line 10, "said" should be deleted.
Line 15, "allows to" should be deleted.

Signed and Sealed this

Twentieth Day of February, 1996

Bruce Lehman

*Attest:*

BRUCE LEHMAN

*Attesting Officer*

*Commissioner of Patents and Trademarks*